US010663115B2

(12) United States Patent
Kaminsky et al.

(10) Patent No.: US 10,663,115 B2
(45) Date of Patent: May 26, 2020

(54) METHOD OF PURGING A DUAL PURPOSE LNG/LIN STORAGE TANK

(71) Applicants: Robert D. Kaminsky, Houston, TX (US); Fritz Pierre, Jr., Humble, TX (US)

(72) Inventors: Robert D. Kaminsky, Houston, TX (US); Fritz Pierre, Jr., Humble, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 170 days.

(21) Appl. No.: 15/873,624

(22) Filed: Jan. 17, 2018

(65) Prior Publication Data

US 2018/0245740 A1 Aug. 30, 2018

Related U.S. Application Data

(60) Provisional application No. 62/463,274, filed on Feb. 24, 2017.

(51) Int. Cl.
*F17C 5/02* (2006.01)
*F17C 7/02* (2006.01)
(Continued)

(52) U.S. Cl.
CPC ..... *F17C 5/02* (2013.01); *F17C 7/02* (2013.01); *F17C 9/02* (2013.01); *F17C 9/04* (2013.01);
(Continued)

(58) Field of Classification Search
None
See application file for complete search history.

(56) References Cited

U.S. PATENT DOCUMENTS 2,986,010 A 5/1961 Beckwith ..... 62/46
3,018,632 A * 1/1962 Keith ..... F25J 1/0234 62/614
(Continued)

FOREIGN PATENT DOCUMENTS

CN 102206520 10/2011 ..... C10L 3/10
CN 102628635 10/2014 ..... F25J 3/08
(Continued)

OTHER PUBLICATIONS

EP 159234 A (Year: 1985).*
(Continued)

*Primary Examiner* — Len Tran
*Assistant Examiner* — Jenna M Hopkins
(74) *Attorney, Agent, or Firm* — ExxonMobil Upstream Research Company—Law Department

(57) ABSTRACT

A method for loading liquefied nitrogen (LIN) into a cryogenic storage tank initially containing liquid natural gas (LNG) and a vapor space above the LNG. First and second nitrogen gas streams are provided. The first nitrogen stream has a lower temperature than the second nitrogen gas stream. While the LNG is offloaded from the storage tank, the first nitrogen gas stream is injected into the vapor space. The storage tank is then purged by injecting the second nitrogen gas stream into the storage tank to thereby reduce a natural gas content of the vapor space to less than 5 mol %. After purging the storage tank, the storage tank is loaded with LIN.

16 Claims, 3 Drawing Sheets

(51) Int. Cl.
*F17C 9/02* (2006.01)
*F17C 9/04* (2006.01)

(52) U.S. Cl.
CPC .. *F17C 2221/014* (2013.01); *F17C 2221/033* (2013.01); *F17C 2223/013* (2013.01); *F17C 2223/0161* (2013.01); *F17C 2223/033* (2013.01); *F17C 2223/043* (2013.01); *F17C 2223/046* (2013.01); *F17C 2225/013* (2013.01); *F17C 2225/0161* (2013.01); *F17C 2225/033* (2013.01); *F17C 2225/043* (2013.01); *F17C 2225/046* (2013.01); *F17C 2227/01* (2013.01); *F17C 2227/0135* (2013.01); *F17C 2227/0157* (2013.01); *F17C 2227/0306* (2013.01); *F17C 2227/0323* (2013.01); *F17C 2227/0339* (2013.01); *F17C 2227/0341* (2013.01); *F17C 2227/0388* (2013.01); *F17C 2227/044* (2013.01); *F17C 2250/0452* (2013.01); *F17C 2260/04* (2013.01); *F17C 2260/044* (2013.01); *F17C 2260/056* (2013.01); *F17C 2265/05* (2013.01); *F17C 2265/07* (2013.01); *F17C 2270/0102* (2013.01); *F17C 2270/0105* (2013.01); *F17C 2270/0136* (2013.01)

(56) References Cited

U.S. PATENT DOCUMENTS

| | | | | |
|---|---|---|---|---|
| 3,180,709 | A | 4/1965 | Yendall et al. | 23/210 |
| 3,347,055 | A | 10/1967 | Blanchard et al. | 62/9 |
| 3,370,435 | A | 2/1968 | Arregger | 62/28 |
| 3,400,547 | A * | 9/1968 | Williams | F25J 1/0223 62/50.1 |
| 3,724,226 | A | 4/1973 | Pachaly | 62/39 |
| 3,850,001 | A | 11/1974 | Locke | 62/50 |
| 3,857,251 | A * | 12/1974 | Alleaume | F17C 9/04 62/623 |
| 3,878,689 | A | 4/1975 | Grenci | 62/9 |
| 4,415,345 | A | 11/1983 | Swallow | 62/28 |
| 4,604,115 | A * | 8/1986 | Bonneton | F25J 1/0025 62/616 |
| 4,607,489 | A * | 8/1986 | Krongold | F17C 9/02 62/225 |
| 4,620,962 | A * | 11/1986 | Brodbeck | A61L 2/10 210/774 |
| 4,948,404 | A * | 8/1990 | Delong | F25J 1/0015 62/619 |
| 5,025,860 | A | 6/1991 | Mandrin | 166/267 |
| 5,107,906 | A * | 4/1992 | Swenson | F17C 9/02 141/11 |
| 5,137,558 | A | 8/1992 | Agrawal | 62/24 |
| 5,139,547 | A | 8/1992 | Agrawal et al. | 62/8 |
| 5,141,543 | A * | 8/1992 | Agrawal | F17C 9/04 62/612 |
| 5,409,046 | A * | 4/1995 | Swenson | F17C 9/02 141/11 |
| 5,415,001 | A * | 5/1995 | Powars | F17C 9/00 62/47.1 |
| 5,421,162 | A * | 6/1995 | Gustafson | F17C 9/02 123/525 |
| 5,638,698 | A | 6/1997 | Knight et al. | 62/632 |
| 5,950,453 | A | 9/1999 | Bowen et al. | 62/612 |
| 5,964,985 | A * | 10/1999 | Wootten | B01D 53/24 201/14 |
| 6,003,603 | A | 12/1999 | Breivik et al. | 166/357 |
| 6,012,453 | A * | 1/2000 | Tsals | A62B 7/02 128/201.21 |
| 6,209,350 | B1 | 4/2001 | Kimble, III | 62/613 |
| 6,237,347 | B1 * | 5/2001 | Rigby | F17C 5/02 62/48.1 |
| 6,295,838 | B1 | 10/2001 | Shah et al. | 62/643 |
| 6,298,688 | B1 | 10/2001 | Brostow et al. | 62/613 |
| 6,412,302 | B1 | 7/2002 | Foglietta | 62/611 |
| 6,662,589 | B1 | 12/2003 | Roberts et al. | 62/425 |
| 6,889,522 | B2 | 5/2005 | Prible | 62/612 |
| 7,143,606 | B2 | 12/2006 | Tranier | 62/611 |
| 7,278,281 | B2 | 10/2007 | Yang et al. | 62/612 |
| 7,386,996 | B2 | 6/2008 | Fredheim et al. | 62/612 |
| 7,520,143 | B2 | 4/2009 | Spilsbury | 62/620 |
| 7,712,331 | B2 | 5/2010 | Dee et al. | 62/612 |
| 8,079,321 | B2 | 12/2011 | Balasubramanian | 114/74 |
| 8,435,403 | B2 | 5/2013 | Sapper et al. | 208/254 |
| 8,464,289 | B2 | 6/2013 | Pan | 725/34 |
| 8,601,833 | B2 | 12/2013 | Dee et al. | 62/648 |
| 8,616,012 | B2 | 12/2013 | Duerr et al. | 62/89 |
| 8,646,289 | B1 | 2/2014 | Shivers, III et al. | 62/611 |
| 9,016,088 | B2 | 4/2015 | Butts | 62/613 |
| 9,422,037 | B2 | 8/2016 | VanWijngaarden et al. | 114/74 |
| 9,435,229 | B2 | 9/2016 | Alekseev et al. | 60/643 |
| 9,459,042 | B2 | 10/2016 | Chantant | 62/606 |
| 2003/0226373 | A1 | 12/2003 | Prible et al. | 62/612 |
| 2006/0000615 | A1 | 1/2006 | Choi | 166/352 |
| 2008/0000266 | A1 | 1/2008 | Dee et al. | 62/643 |
| 2008/0127654 | A1 * | 6/2008 | Darling | F17C 7/02 62/50.2 |
| 2009/0217701 | A1 | 9/2009 | Minta et al. | 62/612 |
| 2010/0170297 | A1 * | 7/2010 | Oka | F17C 9/04 62/614 |
| 2010/0192626 | A1 | 8/2010 | Chantant | 62/606 |
| 2010/0251763 | A1 | 10/2010 | Audun | 62/614 |
| 2010/0319361 | A1 | 12/2010 | Chantant et al. | 62/50.2 |
| 2011/0036121 | A1 * | 2/2011 | Roberts | F25J 1/0022 62/612 |
| 2011/0126451 | A1 | 6/2011 | Pan et al. | 44/451 |
| 2011/0259044 | A1 | 10/2011 | Baudat et al. | 62/611 |
| 2012/0103010 | A1 | 5/2012 | Butts | 62/613 |
| 2012/0285196 | A1 | 11/2012 | Flinn et al. | 62/620 |
| 2013/0199238 | A1 | 8/2013 | Mock et al. | 62/611 |
| 2014/0130542 | A1 | 5/2014 | Brown et al. | 62/612 |
| 2014/0202583 | A1 * | 7/2014 | Lee et al. | B67D 7/04 141/4 |
| 2015/0285553 | A1 | 10/2015 | Oelfke et al. | 62/611 |
| 2015/0300570 | A1 * | 10/2015 | Beuneken | F17C 5/02 141/4 |
| 2015/0316208 | A1 * | 11/2015 | Bae | B63H 21/38 62/53.2 |
| 2015/0330571 | A1 * | 11/2015 | Beuneken | F17C 5/02 141/4 |
| 2017/0010041 | A1 * | 1/2017 | Pierre, Jr. | F25J 1/0224 |
| 2017/0016667 | A1 * | 1/2017 | Huntington | F25J 1/025 |
| 2017/0016668 | A1 | 1/2017 | Pierre, Jr. et al. | 62/614 |
| 2017/0167785 | A1 * | 6/2017 | Pierre, Jr. | F25J 1/0022 |
| 2017/0167787 | A1 * | 6/2017 | Pierre, Jr. | F25J 1/0015 |
| 2017/0191619 | A1 * | 7/2017 | Snyder | F17C 5/04 |
| 2018/0231305 | A1 * | 8/2018 | Pierre, Jr. | F25J 1/0221 |
| 2019/0285340 | A1 * | 9/2019 | Pierre, Jr. | F25J 1/0221 |

FOREIGN PATENT DOCUMENTS

| | | | | |
|---|---|---|---|---|
| DE | 1960515 | | 5/1971 | F25J 1/02 |
| DE | 2354726 | | 5/1975 | F17C 9/04 |
| DE | 19906602 | | 8/2000 | C10G 5/06 |
| DE | 102013007208 | | 10/2014 | B01D 3/14 |
| EP | 1972875 | | 9/2008 | F25J 3/04 |
| EP | 2444711 | A2 * | 4/2012 | F17C 3/02 |
| EP | 3196534 | A1 * | 7/2017 | F17C 7/02 |
| FR | 2756368 | | 5/1998 | B01D 53/26 |
| GB | 1376678 | | 12/1974 | F25J 1/02 |
| GB | 1596330 | | 8/1981 | F25J 1/02 |
| GB | 2172388 | | 9/1986 | E21B 43/16 |
| GB | 2333148 | | 7/1999 | F25J 1/02 |
| GB | 2470062 | | 11/2010 | F25J 1/02 |
| GB | 2486036 | | 11/2012 | F25J 1/02 |
| JP | S59216785 | | 12/1984 | F17C 13/00 |
| JP | 5705271 | | 4/2015 | B01J 19/00 |
| KR | 2010-0112708 | | 10/2010 | F17C 5/00 |
| WO | WO2006/120127 | | 11/2006 | F25J 3/02 |
| WO | WO-2011002299 | A1 * | 1/2011 | F25J 1/0025 |
| WO | WO-2011141286 | A1 * | 11/2011 | B60H 1/3202 |

(56) References Cited

FOREIGN PATENT DOCUMENTS

| | | | |
|---|---|---|---|
| WO | WO-2012074283 A2 * | 6/2012 | ..... F17C 7/02 |
| WO | WO2014/078092 | 5/2014 | ..... C10L 3/10 |
| WO | WO2015/110443 | 7/2015 | ..... F25J 1/00 |
| WO | WO-2017071742 A1 * | 5/2017 | ..... F25J 1/0015 |

OTHER PUBLICATIONS

WO 2012063944 A1 (Year: 2012).*
U.S. Appl. No. 15/182,050, filed Jun. 14, 2016, Pierre, Fritz Jr. et al.
U.S. Appl. No. 15/347,968, filed Nov. 10, 2016, Pierre, Fritz Jr. et al.
U.S. Appl. No. 15/347,983, filed Nov. 10, 2016, Pierre, Fritz Jr. et al.
U.S. Appl. No. 15/348,004, filed Nov. 10, 2016, Pierre, Fritz Jr. et al.
U.S. Appl. No. 15/348,533, filed Nov. 10, 2016, Pierre, Fritz Jr.
U.S. Appl. No. 62/458,127, filed Feb. 13, 2017, Pierre, Fritz Jr.
U.S. Appl. No. 62/458,131, filed Feb. 13, 2017, Pierre, Fritz Jr.
U.S. Appl. No. 62/463,274, filed Feb. 24, 2017, Kaminsky, Robert D. et al.
U.S. Appl. No. 62/478,961, filed Mar. 30, 2017, Balasubramanian, Sathish.
Bach, Wilfried (1990) "Offshore Natural Gas Liquefaction with Nitrogen Cooling—Process Design and Comparison of Coil-Wound and Plate-Fin Heat Exchangers," *Science and Technology Reports*, No. 64, Jan. 1, 1990, pp. 31-37.
Li, Q. Y. et al. (2010) "Design and Analysis of Liquefaction Process for Offshore Associated Gas Resources," *Applied Thermal Engineering*, v. 30, Jul. 27, 2010, pp. 2518-2525.
Publication No. 43031 (2000) Research Disclosure, Mason Publications, Hampshire, GB, Feb. 1, 2000, p. 239, XP000969014, ISSN: 0374-4353, paragraphs [0004], [0005] & [0006].
Publication No. 37752 (1995) Research Disclosure, Mason Publications, Hampshire, GB, Sep. 1, 1995, p. 632, XP000536225, ISSN: 0374-4353, 1 page.

* cited by examiner

METHOD OF PURGING A DUAL PURPOSE LNG/LIN STORAGE TANK

This application claims the priority benefit of U.S. Patent Application No. 62/463,274 filed Feb. 24, 2017 entitled "METHOD OF PURGING A DUAL PURPOSE LNG/LIN STORAGE TANK", the entirety of which is incorporated by reference herein.

FIELD OF THE INVENTION

The invention relates to the liquefaction of natural gas to form liquefied natural gas (LNG) using liquid nitrogen (LIN) as a coolant, and more specifically, to the storage and/or transport of liquid nitrogen to an LNG liquefaction location using an LNG storage tank.

BACKGROUND

LNG production is a rapidly growing means to supply natural gas from locations with an abundant supply of natural gas to distant locations with a strong demand of natural gas. The conventional LNG cycle includes: (a) initial treatments of the natural gas resource to remove contaminants such as water, sulfur compounds and carbon dioxide; (b) the separation of some heavier hydrocarbon gases, such as propane, butane, pentane, etc. by a variety of possible methods including self-refrigeration, external refrigeration, lean oil, etc.; (c) refrigeration of the natural gas substantially by external refrigeration to form LNG at near atmospheric pressure and about −160° C.; (d) transport of the LNG product in ships or tankers designed for this purpose to a market location; and (e) re-pressurization and re-gasification of the LNG to a pressurized natural gas that may distributed to natural gas consumers. Step (c) of the conventional LNG cycle usually requires the use of large refrigeration compressors often powered by large gas turbine drivers that emit substantial carbon and other emissions. Large capital investments—on the order of billions of US dollars—and extensive infrastructure may be required as part of the liquefaction plant. Step (e) of the conventional LNG cycle generally includes re-pressurizing the LNG to the required pressure using cryogenic pumps and then re-gasifying the LNG to form pressurized natural gas by exchanging heat through an intermediate fluid but ultimately with seawater, or by combusting a portion of the natural gas to heat and vaporize the LNG. Generally, the available exergy of the cryogenic LNG is not utilized.

A cold refrigerant produced at a different location, such as liquefied nitrogen gas ("LIN"), can be used to liquefy natural gas. A process known as the LNG-LIN concept relates to a non-conventional LNG cycle in which at least Step (c) above is replaced by a natural gas liquefaction process that substantially uses liquid nitrogen (LIN) as an open loop source of refrigeration and in which Step (e) above is modified to utilize the exergy of the cryogenic LNG to facilitate the liquefaction of nitrogen gas to form LIN that may then be transported to the resource location and used as a source of refrigeration for the production of LNG. U.S. Pat. No. 3,400,547 describes shipping liquid nitrogen or liquid air from a market place to a field site where it is used to liquefy natural gas. U.S. Pat. No. 3,878,689 describes a process to use LIN as the source of refrigeration to produce LNG. U.S. Pat. No. 5,139,547 describes the use of LNG as a refrigerant to produce LIN.

The LNG-LIN concept further includes the transport of LNG in a ship or tanker from the resource location to the market location and the reverse transport of LIN from the market location to the resource location. The use of the same ship or tanker, and perhaps the use of common onshore tankage, are expected to minimize costs and required infrastructure. As a result, some contamination of the LNG with LIN and some contamination of the LIN with LNG may be expected. Contamination of the LNG with LIN is likely not to be a major concern as natural gas specifications (such as those promulgated by the United States Federal Energy Regulatory Commission) for pipelines and similar distribution means allow for some inert gas to be present. However, since the LIN at the resource location will ultimately be vented to the atmosphere, contamination of the LIN with LNG (which, when regasified as natural gas, is a greenhouse gas more than 20 times as impactful as carbon dioxide) must be reduced to levels acceptable for such venting. Techniques to remove the residual contents of tanks are well known but it may not be economically or environmentally acceptable to achieve the needed low level of contamination to avoid treatment of the LIN or vaporized nitrogen at the resource location prior to venting the gaseous nitrogen (GAN). What is needed is a method of using LIN as a coolant to produce LNG, where if the LIN and the LNG use common storage facilities, any natural gas remaining in the storage facilities is effectively purged prior to filling the storage facilities with LIN.

SUMMARY OF THE INVENTION

The invention provides a method for loading liquefied nitrogen (LIN) into a cryogenic storage tank initially containing liquid natural gas (LNG) and a vapor space above the LNG. First and second nitrogen gas streams are provided. The first nitrogen stream has a lower temperature than the second nitrogen gas stream. While the LNG is offloaded from the storage tank, the first nitrogen gas stream is injected into the vapor space. The storage tank is then purged by injecting the second nitrogen gas stream into the storage tank to thereby reduce a natural gas content of the vapor space to less than 5 mol %. After purging the storage tank, the storage tank is loaded with LIN.

The invention also provides a method of purging a cryogenic storage tank initially containing liquid natural gas (LNG) and a vapor space above the LNG. A first nitrogen gas stream is provided having a temperature within 20° C. of a normal boiling point of the first nitrogen gas stream. A second nitrogen gas stream is provided having a temperature within 20° C. of a temperature of the LNG. The first nitrogen gas stream and the second nitrogen gas stream are slip streams from a nitrogen liquefaction process. The LNG is offloaded from the storage tank while the first nitrogen gas stream is injected into the vapor space. The second nitrogen gas stream is injected into the storage tank, to thereby reduce a methane content of the vapor space to less than 5 mol %. After injecting the second nitrogen gas stream into the storage to tank, the storage tank is loaded with liquid nitrogen (LIN).

The invention also provides a dual-use cryogenic storage tank for alternately storing liquefied natural gas (LNG) and liquid nitrogen (LIN). A liquid outlet is disposed at a low spot in the tank and permits liquids to be removed from the tank. One or more nitrogen gas inlet ports are disposed at or near a top of the tank. The one or more gas inlet ports introduce nitrogen gas into the tank as LNG is removed from the tank through the liquid outlet. One or more additional nitrogen gas inlet ports are disposed near the bottom of the tank and permit additional nitrogen gas to be introduced into the tank. One or more gas outlet ports permit removal of gas from the tank as the additional nitrogen gas is introduced into the tank. One or more liquid inlet ports permit a cryogenic liquid such as LIN to be introduced into the tank while the additional nitrogen gas is removed from the tank through the one or more gas outlet ports.

DETAILED DESCRIPTION

Figure 1:
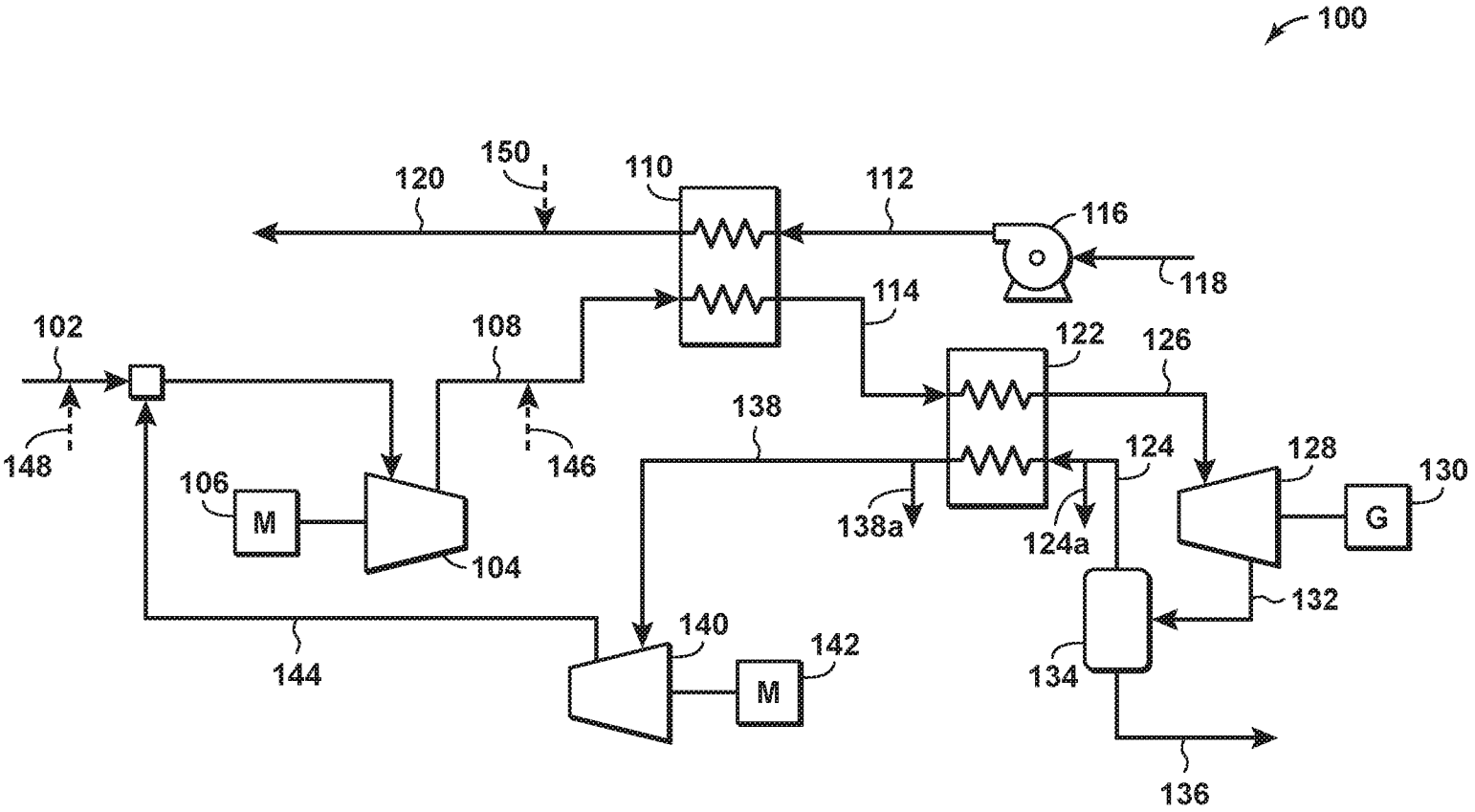
FIG. 1 is a schematic diagram of a system to regasify liquefied natural gas (LNG) while producing liquid nitrogen (LIN)

Various specific aspects and versions of the present disclosure will now be described, including preferred aspects and definitions that are adopted herein. While the following detailed description gives specific preferred aspects, those skilled in the art will appreciate that these aspects are exemplary only, and that the present invention can be practiced in other ways. Any reference to the "invention" may refer to one or more, but not necessarily all, of the aspects defined by the claims. The use of headings is for purposes of convenience only and does not limit the scope of the present invention. For purposes of clarity and brevity, similar reference numbers in the several Figures represent similar items, steps, or structures and may not be described in detail in every Figure.

All numerical values within the detailed description and the claims herein are modified by "about" or "approximately" the indicated value, and take into account experimental error and variations that would be expected by a person having ordinary skill in the art.

As used herein, the term "compressor" means a machine that increases the pressure of a gas by the application of work. A "compressor" or "refrigerant compressor" includes any unit, device, or apparatus able to increase the pressure of a gas stream. This includes compressors having a single compression process or step, or compressors having multi-stage compressions or steps, or more particularly multi-stage compressors within a single casing or shell. Evaporated streams to be compressed can be provided to a compressor at different pressures. Some stages or steps of a cooling process may involve two or more compressors in parallel, series, or both. The present invention is not limited by the type or arrangement or layout of the compressor or compressors, particularly in any refrigerant circuit.

As used herein, "cooling" broadly refers to lowering and/or dropping a temperature and/or internal energy of a substance by any suitable, desired, or required amount. Cooling may include a temperature drop of at least about 1° C., at least about 5° C., at least about 10° C., at least about 15° C., at least about 25° C., at least about 35° C., or least about 50° C., or at least about 75° C., or at least about 85° C., or at least about 95° C., or at least about 100° C. The cooling may use any suitable heat sink, such as steam generation, hot water heating, cooling water, air, refrigerant, other process streams (integration), and combinations thereof. One or more sources of cooling may be combined and/or cascaded to reach a desired outlet temperature. The cooling step may use a cooling unit with any suitable device and/or equipment. According to some aspects, cooling may include indirect heat exchange, such as with one or more heat exchangers. In the alternative, the cooling may use evaporative (heat of vaporization) cooling and/or direct heat exchange, such as a liquid sprayed directly into a process stream.

As used herein, the term "expansion device" refers to one or more devices suitable for reducing the pressure of a fluid in a line (for example, a liquid stream, a vapor stream, or a multiphase stream containing both liquid and vapor). Unless a particular type of expansion device is specifically stated, the expansion device may be (1) at least partially by isenthalpic means, or (2) may be at least partially by isentropic means, or (3) may be a combination of both isentropic means and isenthalpic means. Suitable devices for isenthalpic expansion of natural gas are known in the art and generally include, but are not limited to, manually or automatically, actuated throttling devices such as, for example, valves, control valves, Joule-Thomson (J-T) valves, or venturi devices. Suitable devices for isentropic expansion of natural gas are known in the art and generally include equipment such as expanders or turbo expanders that extract or derive work from such expansion. Suitable devices for isentropic expansion of liquid streams are known in the art and generally include equipment such as expanders, hydraulic expanders, liquid turbines, or turbo expanders that extract or derive work from such expansion. An example of a combination of both isentropic means and isenthalpic means may be a Joule-Thomson valve and a turbo expander in parallel, which provides the capability of using either alone or using both the J-T valve and the turbo expander simultaneously. Isenthalpic or isentropic expansion can be conducted in the all-liquid phase, all-vapor phase, or mixed phases, and can be conducted to facilitate a phase change from a vapor stream or liquid stream to a multiphase stream (a stream having both vapor and liquid phases) or to a single-phase stream different from its initial phase. In the description of the drawings herein, the reference to more than one expansion device in any drawing does not necessarily mean that each expansion device is the same type or size.

The term "gas" is used interchangeably with "vapor," and is defined as a substance or mixture of substances in the gaseous state as distinguished from the liquid or solid state. Likewise, the term "liquid" means a substance or mixture of substances in the liquid state as distinguished from the gas or solid state.

A "heat exchanger" broadly means any device capable of transferring heat energy or cold energy from one medium to another medium, such as between at least two distinct fluids. Heat exchangers include "direct heat exchangers" and "indirect heat exchangers." Thus, a heat exchanger may be of any suitable design, such as a co-current or counter-current heat exchanger, an indirect heat exchanger (e.g. a spiral wound heat exchanger or a plate-fin heat exchanger such as a brazed aluminum plate fin type), direct contact heat exchanger, shell-and-tube heat exchanger, spiral, hairpin, core, core-and-kettle, printed-circuit, double-pipe or any other type of known heat exchanger. "Heat exchanger" may also refer to any column, tower, unit or other arrangement adapted to allow the passage of one or more streams therethrough, and to affect direct or indirect heat exchange between one or more lines of refrigerant, and one or more feed streams.

As used herein, the term "indirect heat exchange" means the bringing of two fluids into heat exchange relation without any physical contact or intermixing of the fluids with each other. Core-in-kettle heat exchangers and brazed aluminum plate-fin heat exchangers are examples of equipment that facilitate indirect heat exchange.

As used herein, the term "natural gas" refers to a multi-component gas obtained from a crude oil well (associated gas) or from a subterranean gas-bearing formation (non-associated gas). The composition and pressure of natural gas can vary significantly. A typical natural gas stream contains methane ($C_1$) as a significant component. The natural gas stream may also contain ethane ($C_2$), higher molecular weight hydrocarbons, and one or more acid gases. The natural gas may also contain minor amounts of contaminants such as water, nitrogen, iron sulfide, wax, and crude oil.

Certain aspects and features have been described using a set of numerical upper limits and a set of numerical lower limits. It should be appreciated that ranges from any lower limit to any upper limit are contemplated unless otherwise indicated. All numerical values are "about" or "approximately" the indicated value, and take into account experimental error and variations that would be expected by a person having ordinary skill in the art.

All patents, test procedures, and other documents cited in this application are fully incorporated by reference to the extent such disclosure is not inconsistent with this application and for all jurisdictions in which such incorporation is permitted.

Described herein are methods and processes to purge an LNG transport tank using nitrogen gas so that the tank subsequently may be used to transport LIN. Specific aspects of the disclosure invention include those set forth in the following paragraphs as described with reference to the Figures. While some features are described with particular reference to only one Figure, they may be equally applicable to the other Figures and may be used in combination with the other Figures or the foregoing discussion.

FIG. 1 is a schematic diagram of an example of a liquid nitrogen (LIN) production system 100 according to aspects of the disclosure. The LIN production system 100 may be at a land-based or ship-based location where LNG is regasified. A nitrogen gas stream 102 is compressed in a nitrogen gas compressor 104, which is driven by a first motor 106 or other motive force, to thereby form a compressed nitrogen gas stream 108. The supplied nitrogen gas of stream 102 preferably has a sufficiently low oxygen content, for example less than 1 mol %, so to avoid flammability issues when contacted with LNG. Residual oxygen may be in the nitrogen gas if the nitrogen was originally separated from air. The compressed nitrogen gas stream 108 passes through a first heat exchanger 110 and is cooled by an LNG stream 112 to form a liquefied compressed nitrogen gas stream 114. The LNG stream 112 is pumped using one or more pumps 116 from an LNG source 118, which in a disclosed aspect may be a land-based or ship-based storage tank, and in a more particularly disclosed aspect may be a dual-purpose storage tank that stores LNG at one time and stores LIN at another time. The first heat exchanger 110 may warm the LNG stream 112 sufficient to form a natural gas stream 120 therefrom, which may then be further warmed, compressed, processed, and/or distributed for power generation or other uses.

The liquefied compressed nitrogen gas stream 114 is passed through a second heat exchanger 122, where it is further cooled via indirect heat exchange with a flash nitrogen gas stream or boil-off nitrogen gas stream 124, the source of which will be further described herein. The subcooled liquefied nitrogen gas stream 126 is expanded, preferably in a work-producing expander 128, to form a partially liquefied nitrogen gas stream where the pressure of the partially liquefied nitrogen gas stream is a pressure suitable for transport of the formed LIN stream 136 to storage. Alternatively, the work-producing expander 128 may be followed by an expansion valve (not shown) to further reduce the pressure of the subcooled liquefied nitrogen gas stream to form the partially liquefied nitrogen gas stream. The work-producing expander 128 may be operationally connected to a generator 130, which may in turn directly or indirectly provide the power to drive the motors, compressors, and/or pumps in system 100 or other systems. The partially liquefied nitrogen gas stream 132 is directed to a separation vessel 134, where the previously mentioned flash nitrogen gas stream or boil-off nitrogen gas stream 124 is separated from the LIN stream 136. The LIN stream 136 may be sent to a land-based or ship-based storage tank, and in a disclosed aspect, may be stored in a dual purpose storage tank configured to store LNG at one time and LIN at another time, as will be further described. The boil-off nitrogen gas stream 124 enters the second heat exchanger 122 at a temperature near the normal boiling point of nitrogen, or approximately −192° C., and cools the liquefied compressed nitrogen gas stream 114. In an aspect, the temperature of the boil-off nitrogen gas stream 124 is within 20° C., or within 10° C., or within 5° C., or within 2° C., or within 1° C. of −192° C. The warm flash or boil-off nitrogen gas stream 138 exits the second heat exchanger 122 at a temperature close to the temperature of the LNG, which is likely to be close to the boiling point of LNG, i.e., −157° C. In an aspect, the temperature of the warmed boil-off nitrogen gas stream is within 20° C., or within 10° C., or within 5° C., or within 2° C., or within 1° C. of −157° C. The warmed boil-off nitrogen gas stream 138 is compressed in a boil-off nitrogen gas compressor 140, which is driven by a second motor 142 or other motive force, to thereby form a compressed boil-off nitrogen gas stream 144. The compressed boil-off nitrogen gas stream 144 is combined with the nitrogen gas stream 102 to be recycled through system 100.

Figure 2:
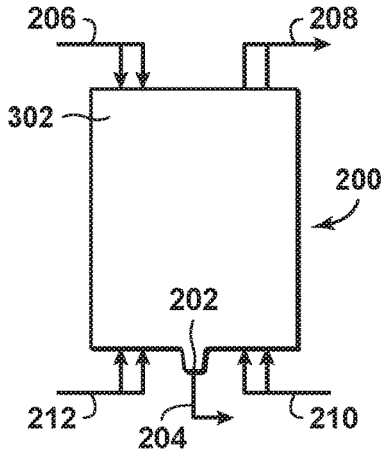
FIG. 2 is a side elevational view of a dual-use LNG/LIN tank according to aspects of the disclosure.

As previously discussed, to fully take advantage of the benefits of an LNG-LIN process, it is preferable to transport LNG from its production location to its regasification location in the same tank that transports LIN from the LNG regasification location to the LNG production location. Such a dual-use tank is shown in FIG. 2 and is indicated generally by reference number 200. Tank 200 may be installed on a transport vessel (not shown) that travels between the LNG production location to the LNG regasification location. Tank 200 includes a low spot, which may be a sump 202, a corner of a tilted tank bottom, or the like. A liquid outlet 204 is disposed at the sump 202 to allow liquids to be virtually completely removed from the tank. Unlike standard LNG transport tanks, there is no need to leave an LNG remainder or "heel" in the tank since the tank will be filled with LIN for the return trip to the LNG production location. One or more gas inlet ports 206 may be disposed at or near the top of the tank. The one or more gas inlet ports 206 may be placed at other locations in the tank. The one or more gas inlet ports 206 permit very cold nitrogen gas to be injected into the tank as the LNG is being pumped out or otherwise removed. In an aspect, the very cold nitrogen gas may be taken from a slip stream 124*a* of the boil-off nitrogen gas stream 124, which as previously described has a temperature near the nitrogen boiling point, i.e., −192° C. In another aspect, the very cold nitrogen gas may be taken from a slip stream 138*a* of the warmed boil-off nitrogen gas stream 138, which as previously described has a temperature near the natural gas boiling point, i.e., −157° C. In still another aspect, the very cold nitrogen gas may be a combination of gas taken from slip stream 124*a* and 138*a*, or from other nitrogen gas streams of the system 100. Tank 200 also has one or more gas outlet ports 208 to permit removal of gas while liquids are loaded into the tank. The tank also has one or more liquid inlet ports 210 to permit liquid, such as LNG or LIN, to be pumped into the tank. The one or more liquid inlet ports may preferably be disposed at or near the bottom of the tank, but may be disposed at any location in the tank as desired or required. Additional gas inlet ports 212 are disposed at or near the bottom of the tank. The additional gas inlet ports permit cold nitrogen gas to be injected into the tank as natural gas and other vapors are being purged from the tank. In an aspect, the cold nitrogen gas may be taken from slip stream 138*a*, slip stream 124*a*, another nitrogen gas stream of system 100, or a combination thereof.

Figure 3A:
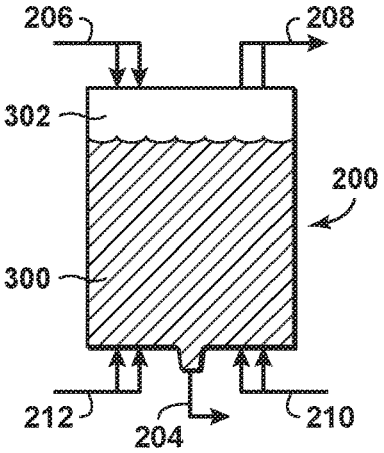
FIGS. 3A-3D are side elevational views of a dual use LNG/LIN tank at various times in a purging process according to aspects of the disclosure.
Figure 3B:
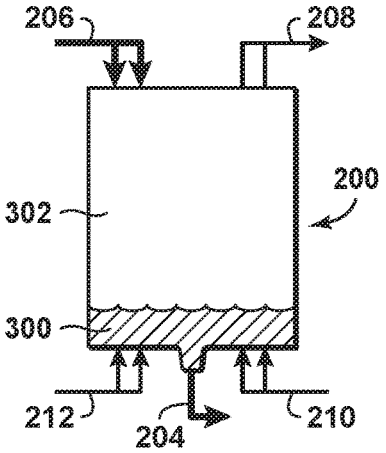

A process or method of purging tank 200 according to disclosed aspects is shown in FIGS. 3A-3D. Bolded or thickened lines in these Figures represent inlets or outlets that are in use during the step of the process or method shown in the respective Figure. FIG. 3A represents the state of tank 200 at the beginning of the process or method. Tank 200 is filled or nearly filled with LNG 300, with the composition of any gas in the vapor space 302 above the LNG in the tank being approximately 90 mol % methane or higher. When the LNG is offloaded (FIG. 3B), the LNG is pumped or otherwise evacuated through liquid outlet 204. At the same time, very cold nitrogen gas, which as previously discussed may comprise gas from slip stream 124*a* and/or 138*a*, is injected into the tank via the one or more gas inlet ports 206. In an aspect, the temperature of the very cold nitrogen gas injected through gas inlet ports 206 may be colder than the LNG boiling point, to keep the temperature within the tank cold enough to prevent or substantially reduce the amount of LNG boil-off in the tank. Once the LNG is completely removed from the tank, the composition of the remaining vapor may be less than 20 mol % methane, or less than 10 mol % methane, or less than 8 mol % methane, or less than 5 mol % methane, or less than 3 mol % methane.

Figure 3C:
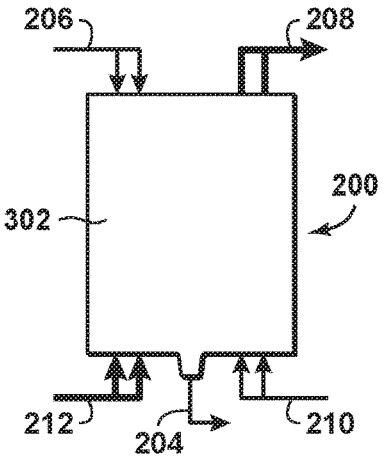
Figure 3D:
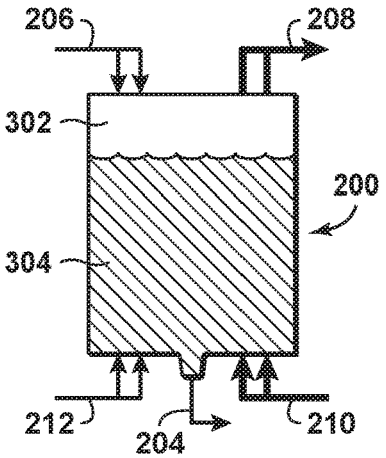

The remaining vapor is then purged from the vapor space 302 of the tank 200 through the one or more gas outlet ports 208 by injecting a cold nitrogen gas stream into the tank through the additional gas inlet ports 212 (FIG. 3C). In an aspect, the purged vapor may be recycled back into the LIN production system (e.g., via line 146 or line 148 as shown in FIG. 1) to reduce or eliminate undesired emissions into the atmosphere. This aspect would be a desirable option where, for example, the LNG/LIN carrier arrival frequency is infrequent enough such that enough liquid nitrogen is produced and stored to sufficiently dilute the hydrocarbon concentration in the tank to suitable levels. Alternatively, the purged vapor in some aspects may be compressed and combined with the natural gas stream 120 via a line 150. This aspect would be a desirable option where, for example, the LNG/LIN carrier arrival rate is more frequent, and in such a circumstance a temporary spike in the nitrogen concentration of the natural gas stream may be created. The cold nitrogen gas stream may be taken from any portion of system 100 including slip stream 124*a* and/or 138*a*, and in a preferred aspect the cold nitrogen gas stream is taken from slip stream 138*a*. Slip stream 138*a* is somewhat warmer than the very cold nitrogen gas already present in the tank (which in a preferred aspect was taken from slip stream 124*a*), and such arrangement therefore may provide approximately twice the amount of volume displacement for the same amount of nitrogen gas mass flow. The purging process may reduce the composition of the post-purge vapor to less than 2 mol % methane, or less than 1 mol % methane, or less than 0.5 mol % methane, or less than 0.1 mol % methane, or less than 0.05 mol % methane. The purging process shown in FIG. 3C may be determined to be complete when the internal temperature of the tank reaches a predetermined amount, or when a predetermined amount of cold nitrogen gas is introduced into the tank, or when a predetermined time has passed, or when a measurement of the mol % of methane has been reduced to a certain amount. Once it is determined the purging process is complete, LIN 304 is loaded into the tank through the one or more liquid inlet ports 210 (FIG. 3D). As the tank fills with LIN, the post-purge vapor in the vapor space 302 is evacuated from the tank and may be directed to be combined with one or more of the nitrogen gas streams within the LIN production system 100, for example, at a location upstream of or downstream of the second heat exchanger 122. Because of the purging process disclosed herein, the LIN after filling the tank 200 may have a concentration of less than 100 parts per million (ppm) methane for a shipping period of three to four days at a LIN production capacity of approximately 5 MTA (million tons per year). Alternatively, the remaining LIN in the tank may have less than 80 ppm methane, or less than 50 ppm methane, or less than 30 ppm methane, or less than 20 ppm methane, or less than 10 ppm methane.

Aspects of the disclosure may be modified in many ways while keeping with the spirit of the invention. For example, throughout this disclosure the proportion of methane in the vapor space of the tank has been described as a mol % by mass. Alternatively, as natural gas may be comprised of more than just methane, it may be advantageous to instead speak of the proportion of non-nitrogen gases present in the vapor space as measured by a mol % by mass. Additionally, the number and positioning of the gas inlet ports 206, gas outlet ports 208, and additional gas inlet ports 212 may be varied as desired or required.

Figure 4:
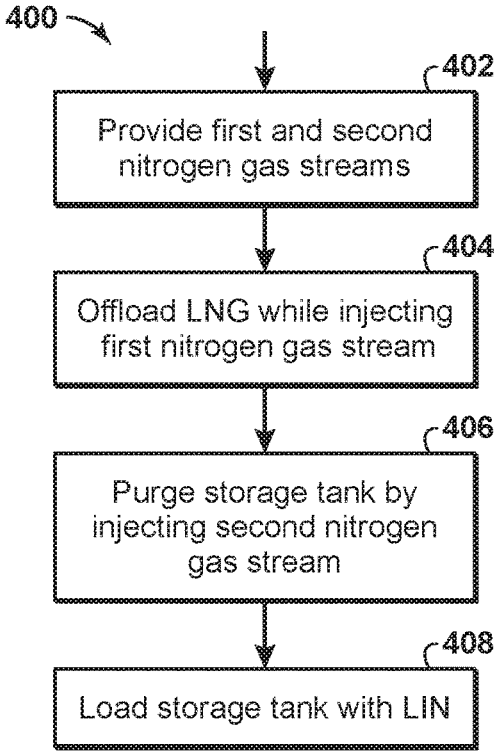
FIG. 4 is a flowchart of a method according to aspects of the disclosure.

FIG. 4 is a method 400 for loading liquefied nitrogen (LIN) into a cryogenic storage tank initially containing liquid natural gas (LNG) and a vapor space above the LNG. At block 402 a first nitrogen gas stream and a second nitrogen gas stream are provided. The first nitrogen stream has a temperature lower than a temperature of the second nitrogen gas stream. At block 404 the LNG is offloaded from the storage tank while injecting the first nitrogen gas stream into the vapor space. At block 406 the storage tank is purged by injecting the second nitrogen gas stream into the storage tank, to thereby reduce a methane content of the vapor space to less than 5 mol %. After purging the storage tank, at block 408 the storage tank is loaded with LIN.

Figure 5:
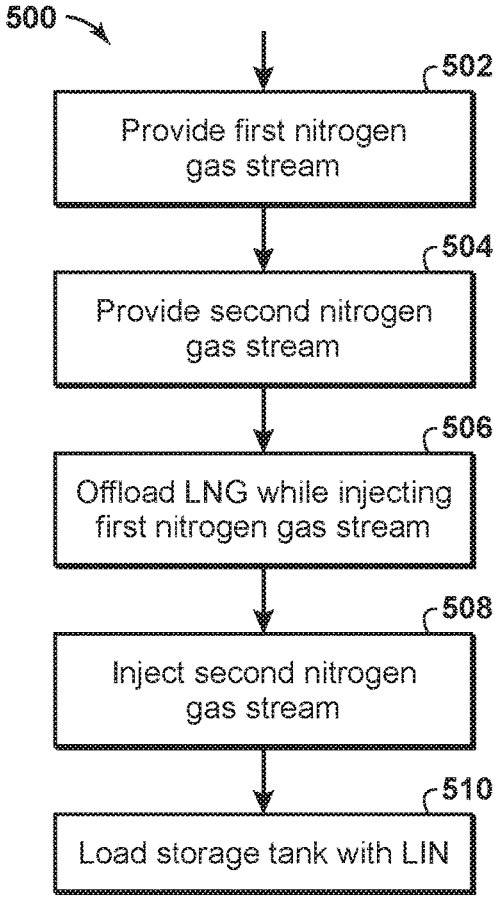
FIG. 5 is a flowchart of a method according to aspects of the disclosure.

FIG. 5 is a method 500 of purging a cryogenic storage tank initially containing liquid natural gas (LNG) and a vapor space above the LNG. At block 502 a first nitrogen gas stream is provided having a temperature within 20° C. of a normal boiling point of the first nitrogen gas stream. At block 504 a second nitrogen gas stream is provided having a temperature within 20° C. of a temperature of the LNG. The first nitrogen gas stream and the second nitrogen gas stream are slip streams from a nitrogen liquefaction process. At block 506 the LNG is offloaded from the storage tank while the first nitrogen gas stream is injected into the vapor space. At block 508 the second nitrogen gas stream is injected into the storage tank, to thereby reduce a methane content of the vapor space to less than 5 mol %. After injecting the second nitrogen gas stream into the storage tank, at block 510 the storage tank is loaded with liquid nitrogen (LIN).

The aspects disclosed herein provide a method of purging a dual-use cryogenic LNG/LIN storage tank. An advantage of the disclosed aspects is that natural gas in stored/transported LIN is at an acceptably low level. Another advantage is that the disclosed method of purging permits the storage tank to be essentially emptied of LNG. No remainder or "heel" is required to remain in the tank. This reinforces the dual-use nature of the tank, and further lowers the natural gas content in the tank when LIN is loaded therein. Still another advantage is that the nitrogen gas used for purging is taken from the LIN production/LNG regasification system. No additional purge gas streams are required to be produced. Yet another advantage is that the gas purged from the storage tank can be recycled back into the LIN production system. This closed system reduces or even eliminates undesired emissions into the atmosphere.

Aspects of the disclosure may include any combinations of the methods and systems shown in the following numbered paragraphs. This is not to be considered a complete listing of all possible aspects, as any number of variations can be envisioned from the description above.

1. A method for loading liquefied nitrogen (LIN) into a cryogenic storage tank initially containing liquid natural gas (LNG) and a vapor space above the LNG, the method comprising:

providing a first nitrogen gas stream and a second nitrogen gas stream, where the first nitrogen stream has a temperature lower than a temperature of the second nitrogen gas stream;

offloading the LNG from the storage tank while injecting the first nitrogen gas stream into the vapor space;

purging the storage tank by injecting the second nitrogen gas stream into the storage tank, to thereby reduce a methane content of the vapor space to less than 5 mol %; and after purging the storage tank, loading the storage tank with LIN.

2. The method of paragraph 1, wherein the temperature of the first nitrogen gas stream is within 5° C. of a normal boiling point of the first nitrogen gas stream.

3. The method of paragraph 1 or paragraph 2, wherein the temperature of the second nitrogen gas stream is within 5° C. of a temperature of the LNG.

4. The method of any one of paragraphs 1-3, wherein the first nitrogen gas stream and the second nitrogen gas stream are slip streams from a nitrogen liquefaction process.

5. The method of paragraph 4, further comprising using available cold from regasification of the LNG to liquefy the nitrogen in the nitrogen liquefaction process.

6. The method of paragraph 4, further comprising expanding a pressurized liquefied nitrogen gas stream in the nitrogen liquefaction process to produce LIN and a boil-off nitrogen gas stream, wherein a portion of the boil-off nitrogen gas stream is the first nitrogen gas stream.

7. The method of paragraph 6, further comprising, prior to expanding the pressurized liquefied nitrogen gas stream, cooling the pressurized liquefied nitrogen gas stream using the boil-off nitrogen gas stream to produce a warm boil-off nitrogen gas stream, wherein a portion of the warm boil-off nitrogen gas stream is the second nitrogen gas stream.

8. The method of paragraph 4, wherein a gas stream ejected from the storage tank during LIN loading is mixed with a nitrogen gas stream within the nitrogen liquefaction process.

9. The method of paragraph 8, wherein the nitrogen gas stream within the nitrogen liquefaction process comprises the second nitrogen gas stream.

10. The method of any one of paragraphs 1-9, wherein a gas stream ejected from the storage tank during LIN loading is mixed with a boil-off natural gas stream.

11. The method of any one of paragraphs 1-10, wherein a gas stream ejected from the storage tank from the purging of the storage tank is mixed with an LNG boil-off gas stream.

12. The method of any one of paragraphs 1-11, wherein a methane content of a gas in the vapor space prior to injecting the second nitrogen gas stream is less than 20 mol %.

13. The method of any one of paragraphs 1-12, wherein a methane content of a gas in the vapor space prior to loading the LIN into the tank is less than 2 mol %.

14. The method of any one of paragraphs 1-13, wherein a methane content of the LIN after being loaded in the storage tank is less than 100 ppm.

15. The method of any one of paragraphs 1-14, wherein the first nitrogen gas stream and the second nitrogen gas stream have an oxygen concentration of less than 1 mol %.

16. The method of any one of paragraphs 1-15, wherein a gas stream ejected from the storage tank during LIN loading is mixed with a natural gas stream created by regasification of the LNG.

17. A method of purging a cryogenic storage tank initially containing liquid natural gas (LNG) and a vapor space above the LNG, the method comprising:

providing a first nitrogen gas stream with a temperature within 20° C. of a normal boiling point of the first nitrogen gas stream;

providing a second nitrogen gas stream with a temperature within 20° C. of a temperature of the LNG;

wherein the first nitrogen gas stream and the second nitrogen gas stream are slip streams from a nitrogen liquefaction process;

offloading the LNG from the storage tank while injecting the first nitrogen gas stream into the vapor space;

injecting the second nitrogen gas stream into the storage tank, to thereby reduce a methane content of the vapor space to less than 5 mol %; and after injecting the second nitrogen gas stream into the storage tank, loading the storage tank with liquid nitrogen (LIN).

18. A dual-use cryogenic storage tank for alternately storing liquefied natural gas (LNG) and liquid nitrogen (LIN), comprising:

a liquid outlet disposed at a low spot in the tank and configured to permit liquids to be removed from the tank;

one or more nitrogen gas inlet ports disposed at or near a top of the tank, the one or more gas inlet ports configured to introduce nitrogen gas into the tank as LNG is removed from the tank through the liquid outlet;

one or more additional nitrogen gas inlet ports disposed near the bottom of the tank and configured to permit additional nitrogen gas to be introduced into the tank;

one or more gas outlet ports configured to permit removal of gas from the tank as the additional nitrogen gas is introduced into the tank; and one or more liquid inlet ports configured to permit a cryogenic liquid such as LIN to be introduced into the tank while the additional nitrogen gas is removed from the tank through the one or more gas outlet ports.

While the foregoing is directed to aspects of the present disclosure, other and further aspects of the disclosure may be devised without departing from the basic scope thereof, and the scope thereof is determined by the claims that follow.

What is claimed is:

1. A method for loading liquefied nitrogen (LIN) into a cryogenic storage tank initially containing liquid natural gas (LNG) and a vapor space above the LNG, the method comprising:

providing a first nitrogen gas stream and a second nitrogen gas stream, where the first nitrogen stream has a temperature lower than a temperature of the second nitrogen gas stream;

offloading the LNG from the cryogenic storage tank while injecting the first nitrogen gas stream into the vapor space;

purging the cryogenic storage tank by injecting the second nitrogen gas stream into the cryogenic storage tank, to thereby reduce a methane content of the vapor space to less than 5 mol %; and after purging the cryogenic storage tank, loading the storage tank with LIN.

2. The method of claim 1, wherein the temperature of the first nitrogen gas stream is within 5° C. of a normal boiling point of the first nitrogen gas stream.

3. The method of claim 1, wherein the temperature of the second nitrogen gas stream is within 5° C. of a temperature of the LNG.

4. The method of claim 1, wherein the first nitrogen gas stream and the second nitrogen gas stream are slip streams from a nitrogen liquefaction process.

5. The method of claim 4, wherein the LNG exchanges heat with nitrogen to liquefy the nitrogen in the nitrogen liquefaction process.

6. The method of claim 4, further comprising expanding a pressurized liquefied nitrogen gas stream in the nitrogen liquefaction process to produce LIN and a boil-off nitrogen gas stream, wherein a portion of the boil-off nitrogen gas stream is the first nitrogen gas stream.

7. The method of claim 6, further comprising, prior to expanding the pressurized liquefied nitrogen gas stream, cooling the pressurized liquefied nitrogen gas stream using the boil-off nitrogen gas stream to produce a warm boil-off nitrogen gas stream, wherein a portion of the warm boil-off nitrogen gas stream is the second nitrogen gas stream.

8. The method of claim 4, wherein a gas stream ejected from the cryogenic storage tank during LIN loading is mixed with a nitrogen gas stream within the nitrogen liquefaction process.

9. The method of claim 8, wherein the nitrogen gas stream within the nitrogen liquefaction process comprises the second nitrogen gas stream.

10. The method of claim 1, wherein a gas stream ejected from the cryogenic storage tank during LIN loading is mixed with a boil-off natural gas stream.

11. The method of claim 1, wherein a gas stream ejected from the cryogenic storage tank from the purging of the cryogenic storage tank is mixed with an LNG boil-off gas stream.

12. The method of claim 1, wherein a methane content of a gas in the vapor space prior to injecting the second nitrogen gas stream is less than 20 mol %.

13. The method of claim 1, wherein a methane content of a gas in the vapor space prior to loading the LIN into the cryogenic storage tank is less than 2 mol %.

14. The method of claim 1, wherein a methane content of the LIN after being loaded in the cryogenic storage tank is less than 100 ppm.

15. The method of claim 1, wherein the first nitrogen gas stream and the second nitrogen gas stream have an oxygen concentration of less than 1 mol %.

16. The method of claim 1, wherein a gas stream ejected from the cryogenic storage tank during LIN loading is mixed with a natural gas stream created by regasification of the LNG.

* * * * *